US012509873B2

(12) United States Patent
Yachi et al.

(10) Patent No.: US 12,509,873 B2
(45) Date of Patent: Dec. 30, 2025

(54) BUILDING

(71) Applicant: Sekisui House, Ltd., Osaka (JP)

(72) Inventors: Mitsuharu Yachi, Osaka (JP); Makoto Ochiai, Osaka (JP); Kazuki Ichikawa, Osaka (JP)

(73) Assignee: Sekisui House, Ltd., Osaka (JP)

( * ) Notice: Subject to any disclaimer, the term of this patent is extended or adjusted under 35 U.S.C. 154(b) by 240 days.

(21) Appl. No.: 18/267,412

(22) PCT Filed: Dec. 17, 2020

(86) PCT No.: PCT/JP2020/047222
§ 371 (c)(1),
(2) Date: Jun. 14, 2023

(87) PCT Pub. No.: WO2022/130580
PCT Pub. Date: Jun. 23, 2022

(65) Prior Publication Data

US 2024/0052623 A1 Feb. 15, 2024

(51) Int. Cl.
*E04B 1/00* (2006.01)
*E04D 13/04* (2006.01)
*E04F 15/18* (2006.01)

(52) U.S. Cl.
CPC ..... *E04B 1/003* (2013.01); *E04D 13/04* (2013.01); *E04F 15/18* (2013.01)

(58) Field of Classification Search
CPC ..... E04B 1/003; E04B 1/00; E04D 13/0477; E04D 13/04; E04D 11/005; E04D 11/007
See application file for complete search history.

(56) References Cited

U.S. PATENT DOCUMENTS 5,483,773 A * 1/1996 Parisien ..... E04B 1/003 52/656.1
5,588,264 A * 12/1996 Buzon ..... E04F 15/0247 108/150
7,434,358 B2 * 10/2008 Smith ..... E04B 1/34342 52/302.1
8,381,461 B2 * 2/2013 Repasky ..... E04D 11/007 52/126.6

(Continued)

FOREIGN PATENT DOCUMENTS

AU 2005211518 A1 3/2006
JP S61-165434 A 7/1986

(Continued)

OTHER PUBLICATIONS

International Search Report dated Mar. 16, 2021, in connection with International Application No. PCT/JP2020/047222.

*Primary Examiner* — Brian E Glessner
*Assistant Examiner* — Daniel J Kenny
(74) *Attorney, Agent, or Firm* — Wolf, Greenfield & Sacks, P.C.

(57) ABSTRACT

A building includes a structural body having a floor projecting outside. The structural body includes base members, a cross member extending between the base members, a base portion supported by the cross member, props arranged on the base portion, a floor member supported by the props, and a reinforcement member that reinforces the structural body. The reinforcement member is arranged at a lower position than the base portion and extends between the base members.

4 Claims, 2 Drawing Sheets

(56) References Cited

U.S. PATENT DOCUMENTS

| | | | | |
|---|---|---|---|---|
| 8,959,844 | B2 * | 2/2015 | Ingalls | E02D 27/01 52/93.2 |
| 9,957,016 | B2 | 5/2018 | Grimaldi | |
| 10,844,615 | B2 * | 11/2020 | Esh, Jr. | E04B 1/003 |
| 2005/0072081 | A1 * | 4/2005 | Goebel | E04D 13/0477 52/302.1 |
| 2014/0339487 | A1 | 11/2014 | Robinson | |
| 2021/0396018 | A1 * | 12/2021 | Collins | E04B 1/003 |

FOREIGN PATENT DOCUMENTS

| | | | |
|---|---|---|---|
| JP | 10331222 | * | 5/1997 |
| JP | H11-293763 | A | 10/1999 |
| JP | 20042253051 | * | 1/2003 |
| JP | 2004-116160 | A | 4/2004 |
| JP | 2010-265679 | A | 11/2010 |
| JP | 2017-082501 | A | 5/2017 |

* cited by examiner

BUILDING

CROSS REFERENCE TO RELATED APPLICATIONS

This Application is a national stage filing under 35 U.S.C. 371 of International Patent Application Serial No. PCT/JP2020/047222, filed Dec. 17, 2020, entitled "BUILDING." The entire content of this application is incorporated herein by reference in its entirety.

TECHNICAL FIELD

The present invention relates to a building including a structural body that has a floor projecting outside.

BACKGROUND ART

Patent Literature 1 discloses a building including a deck. The deck includes a support portion, a support device arranged on the support portion, and a tile supported by the support device.

CITATION LIST

Patent Literature

Patent Document 1: Australian Patent Application Publication No. 2005211518

SUMMARY OF INVENTION

Technical Problem

There is still room for improvement in the strength of a structural body that includes a floor projecting outside.

Solution to Problem (1) A building that provides a solution to the above problem includes a structural body that has a floor projecting outside. The structural body includes base members, a cross member, a base portion, props, a floor member, and a reinforcement member. The cross member extends between the base members. The base portion is supported by the cross member. The props are arranged on the base portion. The floor member is supported by the props. The reinforcement member reinforces the structural body. The reinforcement member is arranged at a lower position than the base portion and extends between the base members. This structure improves the strength of the structural body that has the floor projecting outside.

(2) In the building according to description (1), at least one of the props is arranged above the cross member with the base portion located in between. With this structure, the cross member supports the floor member with the prop located in between. This restricts bending of the floor member in the vertical direction.

(3) The building according to description (1) or (2) includes a room connected to the structural body. The floor member in the structural body forms a floor surface that has the same height as a floor surface of the room. This allows a user to smoothly move to the floor projecting outside from the room.

(4) In the building according to any one of descriptions (1) to (3), the base portion includes an underlayer and a waterproof layer arranged on the underlayer. This limits deterioration of the base portion.

(5) In the building according to any one of descriptions (1) to (4), the base portion is sloped.

This structure allows water to drain quickly.

(6) In the building according to description (5), the structural body further includes a first drain pipe and a second drain pipe. The first drain pipe is connected to a lowermost part of the base portion. The second drain pipe is connected to a part of the base portion that is higher than the part connected to the first drain pipe. This avoids the overflow of water onto the floor surface.

Advantageous Effects of Invention

The above-described building improves the strength of the structural body having the floor projecting outside.

DESCRIPTION OF EMBODIMENT

A building will now be described with reference to FIGS. 1 to 4.

Figure 1:
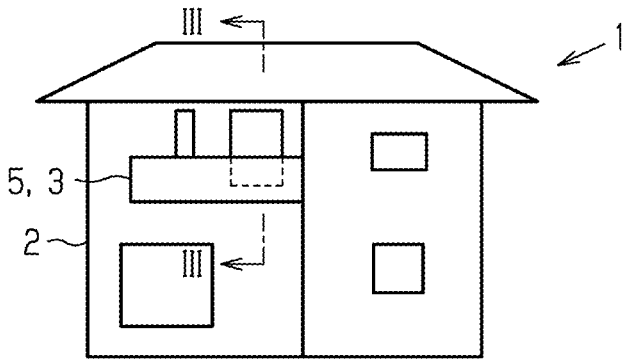
FIG. 1 is a front view of a building.
Figure 2:
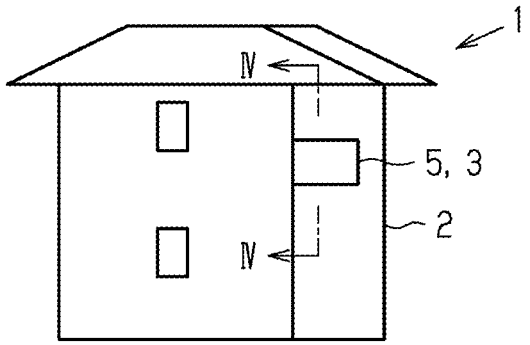
FIG. 2 is a side view of the building.

As shown in FIGS. 1 and 2, a building 1 includes a main body 2 and a structural body 3. The structural body 3 has a floor projecting outside the main body 2. The building 1 further includes a room 4 connected to the structural body 3 (refer to FIG. 3).

Examples of the structural body 3 include a balcony 5, a veranda, a terrace, and a deck. The structural body 3 may be arranged on the ground floor of the building 1. The structural body 3 may be arranged on a floor higher than the ground floor of the building 1. In the present embodiment, the balcony 5 is described as an example of the structural body 3.

Figure 3:
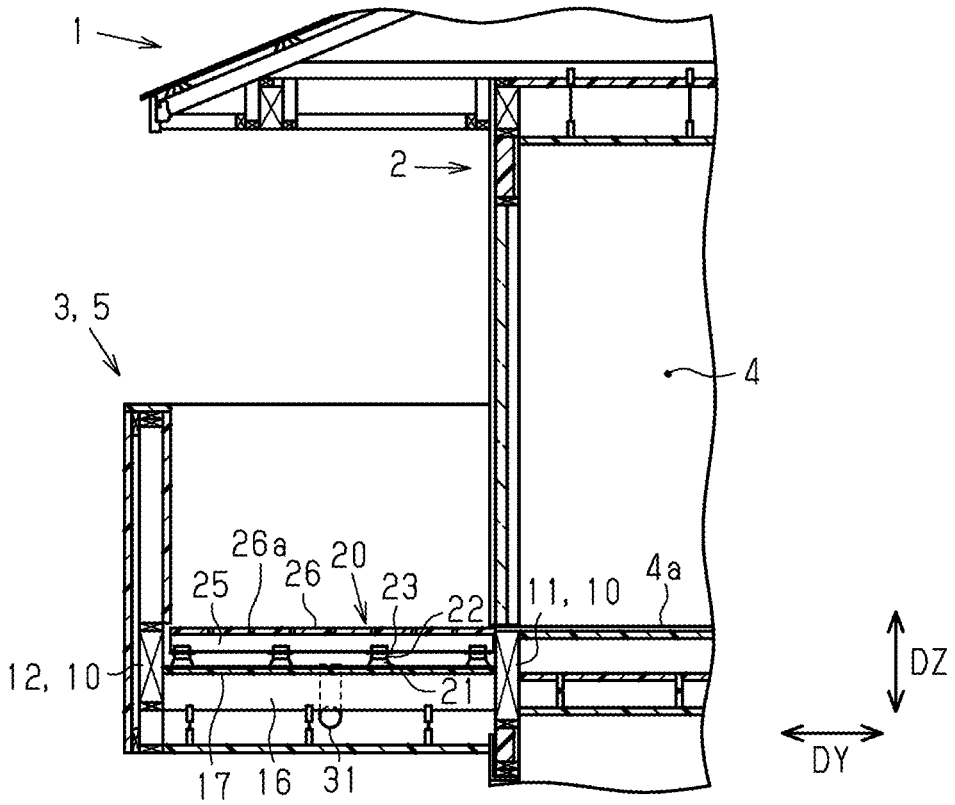
FIG. 3 is a cross-sectional view of the building taken along line III-III in FIG. 1.
Figure 4:
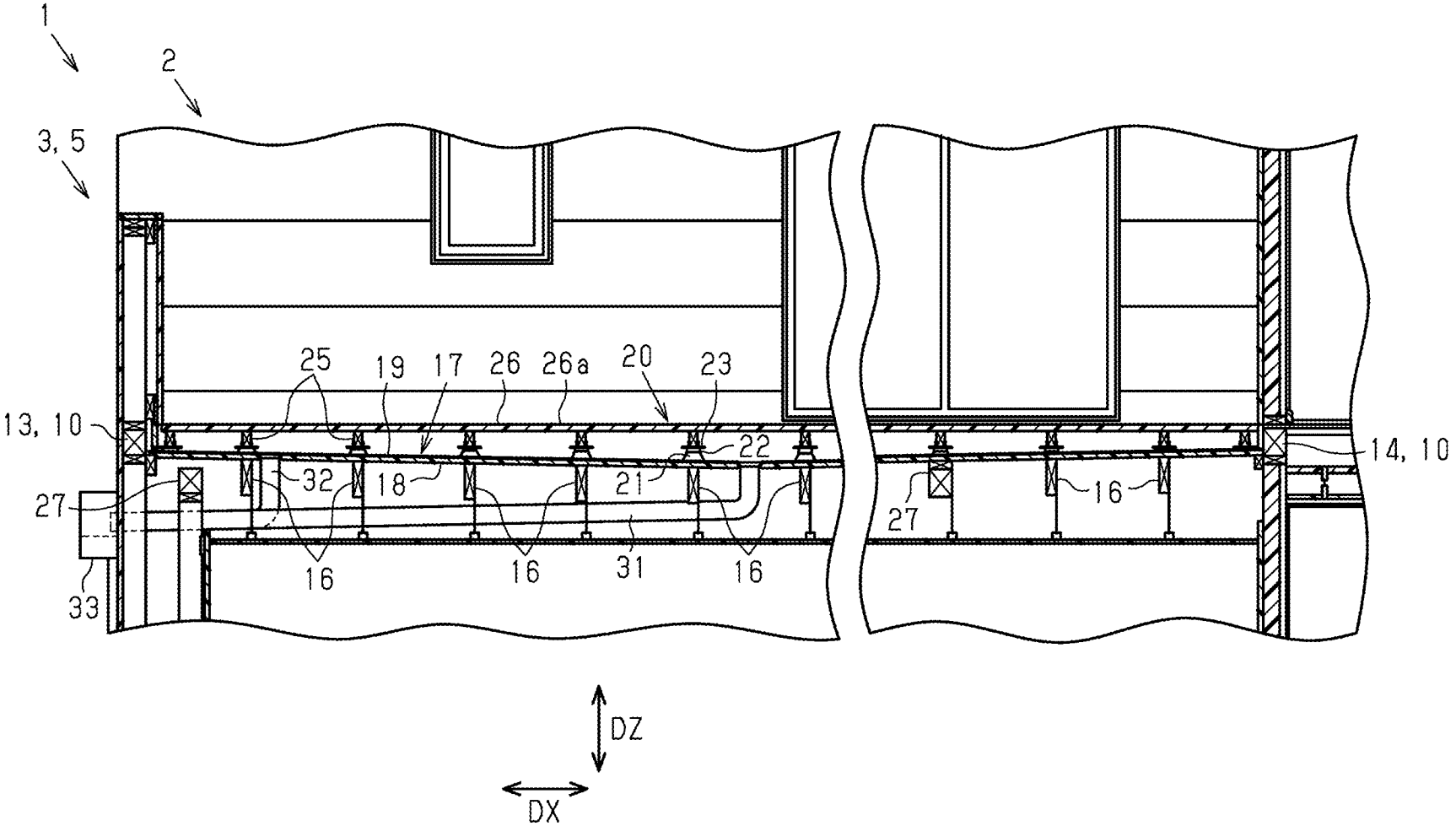
FIG. 4 is a cross-sectional view of the building taken along line IV-IV in FIG. 2.

As shown in FIGS. 3 and 4, the balcony 5 includes base members 10, cross members 16, a base portion 17, props 20, floor supports 25, floor members 26, and reinforcement members 27. The balcony 5 may further include a first drain pipe 31 and a second drain pipe 32. In the description of the balcony 5, the vertical direction will be referred to as the height direction DZ, the direction extending parallel to the wall of the main body 2 will be referred to as the widthwise direction DX, and the direction orthogonal to the widthwise direction DX and the height direction DZ will be referred to as the lengthwise direction DY.

The base members 10 of the balcony 5 include a first base member 11, a second base member 12, a third base member 13, and a fourth base member 14. The first to fourth base members 11 to 14 are formed from wood or steel. The first and second base members 11 and 12 are thicker than the third base member 13 and the fourth base member 14. Specifically, the dimensions of the first and second base members 11 and 12 in the height direction DZ are at least two times greater than the dimensions of the third and fourth base members 13 and 14 in the height direction DZ. The dimensions of the first and second base members 11 and 12 in a direction intersecting the height direction DZ are equal to the dimensions of the third and fourth base members 13 and 14 in the direction intersecting the height direction DZ. The first base member 11 forms a beam of the main body 2. The second base member 12 is arranged parallel to the first base member 11 at a position separated from the first base member 11 by a predetermined distance in the horizontal direction. The second base member 12 is fixed to the first base member 11 by the third and fourth base members 13 and 14. The third base member 13 supports one end of the balcony 5 in the widthwise direction DX, and the fourth base member 14 supports the other end of the balcony 5. The third and fourth base members 13 and 14 extend from the first base member 11 to the second base member 12.

The cross members 16 extend between the base members 10. Specifically, the cross members 16 are arranged to extend from the first base member 11 to the second base member 12. The cross members 16 are arranged parallel to the third and fourth base members 13 and 14 between the third base member 13 and the fourth base member 14. The cross members 16 are arranged such that the height of the cross members 16 gradually becomes lower toward the middle from the ends in the widthwise direction DX.

The base portion 17 is supported by the cross members 16. The base portion 17 extends over the cross members 16 and is attached to the cross members 16. The base portion 17 is sloped. Specifically, the base portion 17 is downwardly sloped from the ends of the balcony 5 toward the middle of the balcony 5.

In an example, the base portion 17 includes an underlayer 18 and a waterproof layer 19 arranged on the underlayer 18. The underlayer 18 is formed by plate members. Each plate member is arranged on the cross members 16. The plate members are laid out over the entire balcony 5 to form the underlayer 18. The waterproof layer 19 is formed by a waterproof sheet. The waterproof sheet covers the entire underlayer 18.

The props 20 are arranged on the base portion 17. Each prop 20 includes a seat 21, a shaft 22, and a rest 23. The shaft 22 is arranged on the seat 21 in a movable manner. Each floor support 25 is set on the rest 23. The shaft 22 is moved relative to the seat 21 in the height direction DZ. For example, a thread is formed in the circumferential surface of the shaft 22. The shaft 22 is rotated to move the shaft 22 upward or downward. The movement of the shaft 22 changes the dimension from the bottom surface of the seat 21 to the upper end surface of the shaft 22. The rest 23 is attached to the upper end surface of the shaft 22.

The first drain pipe 31 has an upper open end connected to the lowermost part of the base portion 17. The first drain pipe 31 has a lower open end connected to drainage 33. The second drain pipe 32 has an upper open end connected to a part of the base portion 17 that is higher than the part of the base portion 17 connected to the first drain pipe 31. The second drain pipe 32 has a lower open end connected to the drainage 33.

At least one of the props 20 is arranged above a cross member 16 with the base portion 17 located in between. Preferably, each one of the props 20 is arranged above the cross members 16 with the base portion 17 located in between. One or more props 20 are arranged above each cross member 16. In an example, the props 20 are arranged next to one another in the lengthwise direction DY. The positions of the shafts 22 of the props 20 are adjusted in the height direction DZ such that the rests 23 are even with one another.

The floor supports 25 are formed from, for example, wood or resin. Each floor support 25 is arranged on the rests 23 of the props 20 that are aligned in the lengthwise direction DY. The floor supports 25 are arranged parallel to one another in the widthwise direction DX. In an example, the floor supports 25 are arranged in equal intervals in the widthwise direction DX.

The floor members 26 are formed from, for example, wood, resin or ceramic. In an example, the floor members 26 set on the floor supports 25 extend across the floor supports 25. The floor members 26 are arranged next to one another in the lengthwise direction DY.

In an example, the floor members 26 form a floor surface **26*a* having the same height as a floor surface 4*a* of the room 4. The floor surface 26*a* formed by the floor members 26 may be lower than the floor surface 4*a* of the room 4. In an example, the floor surface 26*a* formed by the floor members 26 is lower than the floor surface 4*a* of the room 4** by a predetermined height. The predetermined height is set in a range from 5 mm or greater to 15 mm or less.

The reinforcement members 27 are formed from, for example, wood or steel. The reinforcement members 27 reinforce the balcony 5. The reinforcement member 27 are arranged at a lower position than the base portion 17. The reinforcement members 27 extend between the base members 10. Specifically, the reinforcement members 27 extend between the first and second base members 11 and 12. One end of each reinforcement member 27 is forced against the side surface of the first base member 11, and the other end of the reinforcement member 27 is forced against the side surface of the second base member 12. The reinforcement members 27 are thinner than the first and second base members 11 and 12. The reinforcement member 27 may have the same thickness as the third and fourth base members 13 and 14. Alternatively, the reinforcement member 27 may be thicker than the third and fourth base members 13 and 14. The reinforcement members 27 are fixed to the first and second base members 11 and 12 at positions lower than the third and fourth base members 13 and 14.

The operation of the present embodiment will now be described.

The first to fourth base members 11 to 14 support the balcony 5. Further, the reinforcement members 27, which extend between the first and second base members 11 and 12, reinforce the balcony 5. The balcony 5 is supported by the first to fourth base members 11 to 14 and reinforced by the reinforcement member 27. This strengthens the structure of the balcony 5.

In the present embodiment, the second base member 12 is spaced apart from the first base member 11 in the lengthwise direction DY. The second base member 12 is fixed to the first base member 11 by the third and fourth base members 13 and 14. The cross members 16 are arranged between the third and fourth base members 13 and 14. The cross members 16 extend between the first and second base members 11 and 12. The open space above the cross members 16 is used for drainage. If the reinforcement member 27 were to be arranged in the open space, rain water will wet the reinforcement member 27. Thus, the reinforcement members 27 are arranged under the base portion 17. The reinforcement members 27 are fixed to the first and second base members 11 and 12 at positions lower than the third and fourth base members 13 and 14.

In this manner, the balcony 5 includes the first to fourth base members 11 to 14, the cross members 16, and the reinforcement member 27. This improves the strength of the entire balcony 5. Further, the reinforcement members 27 are fixed to the first and second base members 11 and 12 at positions lower than the third and fourth base members 13 and 14. Thus, the balcony 5 resists torsion. Further, the reinforcement members 27 are arranged under the base portion 17. This limits deterioration of the reinforcement member 27.

The present embodiment has the following advantages.

(1) The building 1 includes the structural body 3 having a floor that projects outside. An example of the structural body 3 is the balcony 5. The structural body 3 includes the base members 10, the cross member 16, the base portion 17, the props 20, the floor member 26, and the reinforcement member 27. The base portion 17 is supported by the cross member 16. The floor member 26 is supported by the props 20. The reinforcement member 27 reinforces the structural body 3. The reinforcement member 27 is arranged at a lower position than the base portion 17 and extends between the base members 10. This structure improves the strength of the structural body 3 that has the floor projecting outside.

(2) At least one of the props 20 is arranged above a cross member 16 with the base portion 17 located in between. With this structure, the cross member 16 supports the floor member 26 with the prop 20 located in between. This restricts bending of the floor member 26 in the vertical direction.

(3) The floor surface 26*a* formed by the floor member 26 in the structural body 3 has the same height as the floor surface 4*a* of the room 4. This allows a user to smoothly move to the floor projecting outside from the room 4.

(4) The base portion 17 includes the underlayer 18 and the waterproof layer 19 arranged on the underlayer 18. This limits deterioration of the base portion 17.

(5) The base portion 17 is sloped. This structure allows water to drain quickly. For example, the base portion 17 receives rain water that leaks through gap between the floor members 26. The sloped base portion 17 readily guides the rain water to the first drain pipe 31.

(6) The structural body 3 further includes the first drain pipe 31 and the second drain pipe 32. The first drain pipe 31 is connected to the lowermost part of the base portion 17, and the second drain pipe 32 is connected to a part of the base portion 17 that is higher than the part of the base portion 17 connected to the first drain pipe 31. This avoids the overflow of water onto the floor surface 26*a*.

Modified Examples

The above embodiment exemplifies, without any intention to limit, an applicable form of the building 1. The building 1 can take a form differing from the form described in the embodiment. In an example, some of the components of the embodiment may be replaced, changed, or omitted. Further, another component may be added to the embodiment. Examples of a modification to the embodiment will now be described.

The building 1 may be of any type. The building 1 may be a residential house, a vacation house, a factory, an office building, or a public facility such as a school.

In the present embodiment, the floor members 26 are arranged above the props 20 with the floor supports 25 located in between. However, the floor members 26 may be arranged directly on the props 20.

The structural body 3 may have any planar shape. In the present embodiment, the balcony 5 is rectangular in plan view. Alternatively, the balcony 5 may be triangular or pentagonal in plan view.

REFERENCE SIGNS LIST

1) building, 3) structural body, 4) room, 4*a*) floor surface, 10) base member, 16) cross member, 17) base portion, 18) underlayer, 19) waterproof layer, 20) prop, 26) floor member, 26*a*) floor surface, 27) reinforcement member, 31) first drain pipe, 32) second drain pipe

The invention claimed is:

1. A building comprising:

a structural body including a floor projecting outside, wherein:

the structural body includes base members, a cross member extending between the base members, a base portion supported by the cross member, props arranged on the base portion, a floor member supported by the props, and a reinforcement member that reinforces the structural body, the reinforcement member is arranged at a lower position than the base portion and extends between the base members, the base portion is sloped, the structural body further includes a first drain pipe and a second drain pipe, the first drain pipe is connected to a lowermost part of the base portion, and the second drain pipe is connected to a part of the base portion that is higher than the part connected to the first drain pipe.

2. The building according to claim 1, wherein at least one of the props is arranged above the cross member with the base portion located in between.

3. The building according to claim 1, comprising:

a room connected to the structural body, wherein the floor member in the structural body forms a floor surface having the same height as a floor surface of the room.

4. The building according to claim 1 wherein the base portion includes an underlayer and a waterproof layer arranged on the underlayer.

* * * * *